United States Patent [19]

Snediker

[11] Patent Number: 4,742,633

[45] Date of Patent: May 10, 1988

[54] MODULAR POST-MOUNTED SIGN APPARATUS

[75] Inventor: Robert R. Snediker, Winnetka, Ill.

[73] Assignee: Chicago Show Printing Company, Morton Grove, Ill.

[21] Appl. No.: 886,561

[22] Filed: Jul. 17, 1986

[51] Int. Cl.[4] ..... G09F 15/00

[52] U.S. Cl. ..... 40/607; 40/611

[58] Field of Search ..... 40/611, 607, 606, 612

[56] References Cited

U.S. PATENT DOCUMENTS

| | | | |
|---|---|---|---|
| 1,603,311 | 10/1926 | Brett | 40/607 |
| 2,920,768 | 1/1960 | Halp | 40/606 |
| 3,132,431 | 5/1964 | Petrie | 40/606 |
| 3,493,032 | 2/1970 | Brown | 160/201 |
| 3,605,303 | 9/1971 | Reichow | 40/611 |
| 3,623,255 | 11/1971 | Girard | 40/607 |
| 4,258,494 | 3/1981 | Borgue | 40/607 |
| 4,263,738 | 4/1981 | Donatelle | 40/606 |

FOREIGN PATENT DOCUMENTS

| | | | |
|---|---|---|---|
| 15278 | of 1912 | United Kingdom | 40/607 |

*Primary Examiner*—Henry E. Raduazo

*Attorney, Agent, or Firm*—Dick and Harris

[57] ABSTRACT

An improved modular post-mounted sign apparatus for maintaining a sign in a substantially retained fashion while providing for the facilitated assembly, disassembly and storage of the sign apparatus. A sign panel is telescopically inserted through the open end of the post into an interior cavity such that a portion of the sign panel protrudes outwardly through a slot in the post. The sign panel is retained within the post's interior cavity by a flanged retaining pin assembly affixed to the portion of the sign panel which is telescopically inserted such that the retaining pins preclude the removal of the sign panel from the post member. A cap is removably affixed over the open first end of the post member to further retain the sign panel.

13 Claims, 1 Drawing Sheet

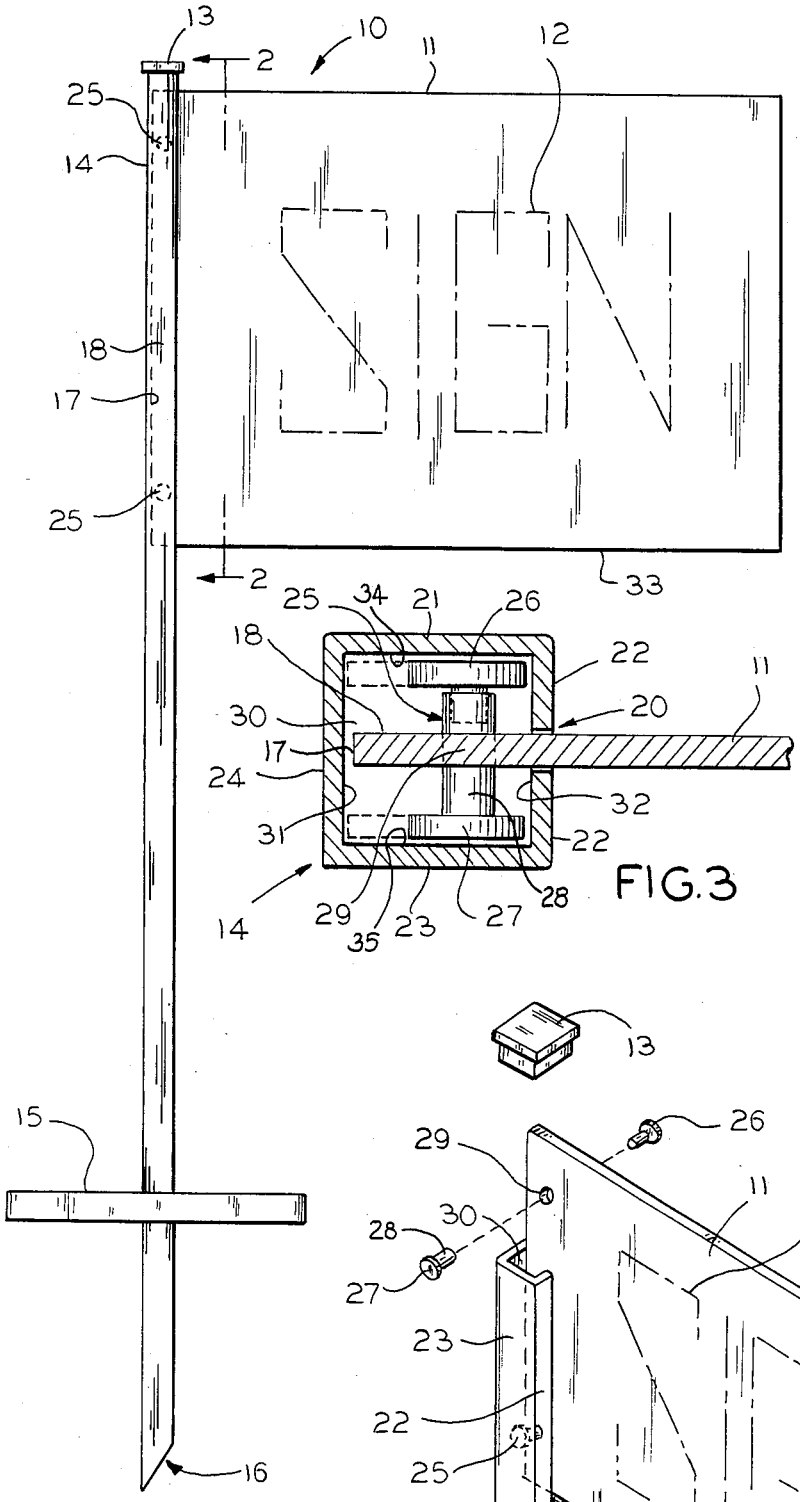
FIG. 1
FIG. 3
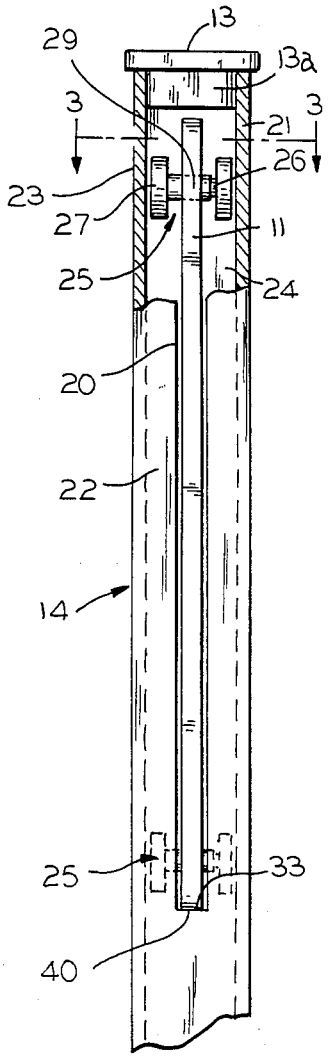
FIG. 2
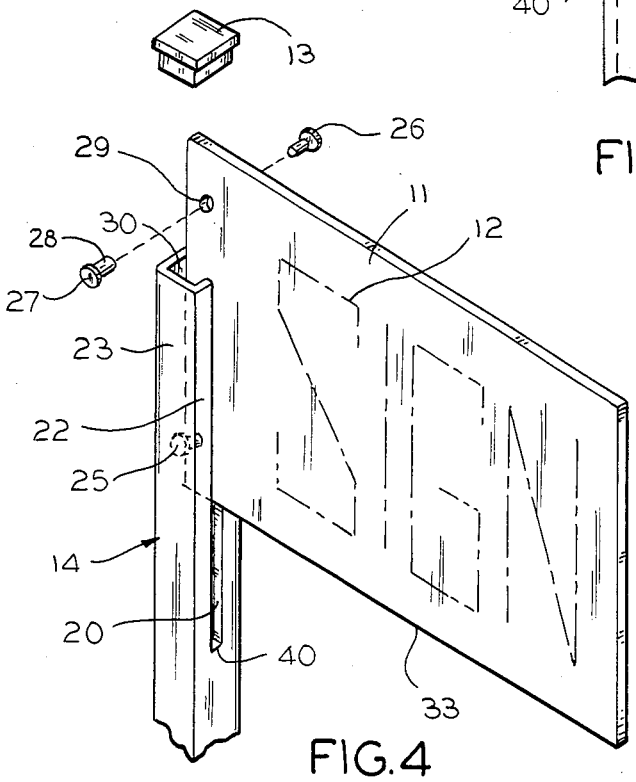
FIG. 4

MODULAR POST-MOUNTED SIGN APPARATUS

BACKGROUND OF THE INVENTION

The present invention relates generally to sign devices and, in particular, to a modular post-mounted sign apparatus for supporting the sign in a substantially retained fashion providing for the facilitated assembly, disassembly and storage thereof.

The environment in which the present invention typically, though not exclusively, would be used is the familiar "For Sale" or "Open House" sign placed upon lawns of residential homes being offered for sale. The prior art sign construction typically comprises a substantially flat wire frame which is anchored upright into the ground. A paper or plastic panel bearing indicia is then folded over the wire frame and affixed thereto either by stapling one face of the sign to the other or through the use of nut and bolt fasteners. Another, more elaborate type of prior art sign apparatus consists of a wooden post driven into the lawn having a yardarm like member extending perpendicular therefrom about the top of the post. The sign itself is then suspended beneath this yardarm by chains or the like. Still another prior art sign holder comprises a square channel vertically positioned in the ground having a portion of the sign inserted therein through a slot cut into the channel. The edge of the sign to be inserted is scored, cut and folded to form wing-like tabs which expand within the channel and "lock" into the corners of the channel to prevent the signs removal. Unfortunately however, each of these prior art type sign apparata have experienced drawbacks which on occasion can diminish the sign's effectiveness. The wire frame type construction sign device is possibly susceptible to deterioration by adverse weather and wind. Additionally, the structural integrity of the wire frame utilized sometimes requires that the sign panel be limited in size or that its overall height be kept relatively short so as to be less susceptible to being torn and otherwise deterioated by blowing winds. The twisting and deterioration which can sometimes occur to such a construction can at times result in a tattered and torn sign esthetically displeasing to the eye and not condusive to the selling of the property. The wooden post and yardarm type sign can at times prove to be difficult to install and often combersome to transport from one location to the another. In addition, as such a sign device may be difficult for a single individual to install additional labor to merely place the sign on the lawn may be required, at an additional cost. Further, the installation typically requires the use of tools to affix the sign to the supporting structure. The third mentioned prior art sign device similarly has inherent features which may make it unsuitable for certain uses. That particular construction relies upon cuts and folds in the sign to form complex wing-like structures which interlock with the corners of the channel interior which are used to retain the sign in place. The scoring and folding may possibly weaken the sign before it is ever exposed to actual use, thereby possibly shortening the useable life of the sign. Further, by design, that construction appears to be limited for use with rectangular shaped posts and signs which have a straight edge corresponding to the straight channel supporting same. Still further, as the sign material itself appears to be the sole means of retaining the sign in the post channel dampness, rain and wind may weaken the sign material thereby possibly diminishing the device's ability to retain the sign in a pleasing manner.

Accordingly, the limitation in the size and shape of the signs which may be displayed by the prior art constructions coupled with the complexity of the assembly of these signs and the difficulty in transporting and storing same has created a need for additional development in this area which is satisfied by the present invention.

Accordingly, it is an object of the present invention to provide a modular post-mounted sign apparatus for supporting a sign in a substantially retained fashion resistant to blowing winds and other adverse weather.

It is additionally an object of the present invention to provide such a sign apparatus which is comprised of a post means having an internal cavity and longitudinal slot therein which is capable of accepting the telescopic interposition of the sign panel to which are affixed flanged retaining pin assemblies whereby the retaining pins and longitudinal slot cooperate with one another to substantially retain the sign panel therewithin.

It is further an object of the present invention to provide such a sign apparatus which may be assembled, disassembled and stored in a facilitated manner by one person without the need for tools or other special implements.

It is yet another object of the invention to provide such a sign apparatus construction which is capable of restrainably displaying sign panels of various sizes and shapes.

As a further object, the present invention provides for a modular post-mounted sign apparatus which can be constructed of a hollow steel channel having a longitudinal slot preliminarly cut therein, a sign panel having retaining pin holes preliminarly formed therethrough and retaining pin means, whereby assembly and disassembly of the sign apparatus may be accomplished in a facilitated manner and which can be transported and stored quite easily.

These and other objects of the invention will become apparent in light of the present specification and drawings.

SUMMARY OF THE INVENTION

The present invention comprises an improved modular post-mounted sign apparatus for supporting a sign in a substantially retained fashion. This particular construction further provides for the facilitated assembly, disassembly and storage of the sign apparatus.

The improved modular post-mounted sign apparatus itself comprises a sign panel means having at least one side which is substantially retained by the post where the sign panel means serves to carry indicia to be displayed. This indicia may be imprinted directly upon the sign panel means itself or alternatively, the indicia may be imprinted upon some other media, such as a plastic, cardboard or paper sheet, which is then attached to the sign panel means. An elongated hollow post means having a first end and a second end is provided for maintaining the sign panel means in a substantially retained fashion resistant to adverse weather conditions such as rain and wind. The post means includes an internal cavity extending from the first end of the post means toward the second end of the post means a distance corresponding to at least the length of the side of the sign panel means to be retained by the post means. The post means further includes a slot extending longitudinally from the first end of the post means toward the second end of the post means a distance corresponding to at least the length of the side of the retained sign panel. This slot has a width substantially corresponding to the thickness of the side panel means. Accordingly, the post means is capable of telescopically accepting the interpositioning of the side of the sign panel means into the internal cavity portion of a post means leaving the remaining portion of the side panel means protruding outwardly from the post means through the longitudinal slot.

Retaining pins are operably affixed to the sign panel means portion telescopically positioned within the internal cavity portion of the post means. The retaining pin means includes a first flange means, a second flange means and an axis means where the axis means serves to connect the first and second flange means together in a substantially "H" shaped fashion. The axis means is of a length which maintains the first and second flange means apart from one another wherein each is thus substantially abutting the respective opposite internal cavity surfaces adjacent the longitudinal slot. The axis is positioned upon the sign panel means so as to maintain the first and second flange means substantially abutting the internal cavity surface proximate to the longitudinal slot and to further maintain the side of the sign panel means substantially abutting the internal cavity surface opposite the longitudinal slot. Accordingly, the placement of the axis means upon the sign panel means results in the sign panel being relatively tightly fit into the internal cavity portion of the post means. The retaining pin means thus serves to increase the effective width of the portion of the sign panel telescopically positioned within the internal cavity of the post means so as to prevent the passage of the sign panel means through the longitudinal slot. The sign panel means may be alternatively inserted and removed from the internal cavity of the post means only through the open first end of the post means. A closure means is provided for removable affixation upon the first end of the post means to thereby alternatively open and close the first end to substantially complete the retention of the sign panel means when the closure means is in its alternatively affixed, closed position. The sign panel means may be removed through the first end of the post means when the closure means is in its alternatively unaffixed, open position. Upon assembly of the sign apparatus, the lower edge of the sign panel means rests against the lower edge of the longitudinal slot. The sign panel means is thereby restrained by the post means through the cooperation of the retaining pin means and the longitudinal slot.

In one embodiment of the invention, the retaining pin means are affixed to the sign panel means such that when the sign panel means is interposed into the internal cavity, the retaining pin means will rest against the interior surface of the internal cavity having the longitudinal slot positioned thereon. The interior facing edge of the retained side of the sign panel means interposed therein will rest against the interior surface of the internal cavity opposite to the longitudinal slot. Accordingly, the interposed portion of the sign panel means is fit relatively tightly into the internal cavity of the post means thereby diminishing any side to side movement of the sign panel means.

In one embodiment of the invention, the sign panel means includes a plurality of retaining pin holes extending from one face of the sign panel means through to the opposite face of the sign panel means. These retaining pin holes are located in the region of the sign panel means which is telescopically interposed into the interior cavity of the post means and serve to accept and facilitate the positioning and affixation of the retaining pin means to the sign panel means. The retaining pin means preferably each comprise a two-piece assembly which is positioned through the corresponding retaining pin hole such that the side panel means is interposed therebetween. The two piece assembly includes the axis means having a first end and a second end where the first end is affixed to the first flange means thereby comprising the first piece. The second end of the axis means is removably affixed to the second flange means where the second flange means thereby comprises the second piece. The axis means with the first flange means affixed thereto may be inserted through the retaining pin hole with the second flange means being affixed thereafter. The retaining pin means thereby serves to increase the effective thickness of the sign panel means in the region of the sign panel means interposed within the interior cavity. This thickened region of the sign panel means is incapable of passing from the interior cavity through the longitudinal slot since the slot substantially corresponds in width to the thickness of the sign panel means alone thereby effectively retaining the sign panel means. These retaining pin holes typically would be preformed through the sign panel means with their location determined by the size of the internal cavity within the post means used therewith.

In the preferred embodiment of the invention the post means comprises an elongaged hollow channel-like post having four walls where opposite walls are substantially parallel with respect to one another. One of these walls includes the longitudinal slot extending from the first end of the post means toward the second end of the post means corresponding to the length of the internal cavity and length of the side of the sign panel means to be retained therein. This longitudinal slot similarly has a width substantially corresponding to the thickness of the sign panel means.

In the preferred embodiment of the invention, the closure means comprises a snap fit plastic cap which is removably affixed to the first end of the post means to thereby seal the first end to further retain the sign panel means and further insulate the region of the sign panel means and retaining pin means from adverse weather which might otherwise possibly deteriorate the sign panel means and/or the retaining pin means and accordingly diminish the retaining ability of the apparatus to effectively retain the sign panel.

In an alternative embodiment of the invention, the first and second flange means are each of a width substantially corresponding to the distance between the internal cavity surface proximate to the longitudinal slot and the internal cavity surface opposite the longitudinal slot. Accordingly, a portion of each of the first and second flange means substantially abutts both the internal cavity surface proximate to the longitudinal slot and the internal cavity surface opposite the longitudinal slot such that the retained side of the sign panel means does not contact the internal cavity surface. The retained side of the sign panel is thus not subjected to friction or wear which might occur due to forces exerted against it within the internal cavity.

In one embodiment of the invention the improved modular post-mounted sign apparatus includes a foot bar operably affixed proximate to the second end of the post means and substantially perpendicular thereto.

This foot bar serves to facilitate the insertion of the sign apparatus into the ground to thereby anchor the apparatus in a substantially upright position by providing a surface where one can place one's foot to force the second end of the post means into the ground. Furthermore the invention described herein preferably includes a stake means operably affixed to the second end of the post means for cutting the ground to facilitate the assembly of the sign apparatus. This stake means can be formed by diagonally cutting the second end of the post means to thereby create a pointed end which can effectively cut into the ground.

In the preferred embodiment of the invention the post means is composed of square steel channel material which need only have the longitudinal slot cut into the first end thereof. In an alternative embodiment of the invention, the post means can be composed of round hollow steel pipe which similarly need only have the longitudinal slot cut into one end thereof. The retaining pin means are preferably composed of substantially resilient weather resistant plastic material. The sign panel means itself is preferably composed of a substantially rigid weather resistant material which is capable of withstanding typical weather conditions without deterioration.

Assembly of the improved post-mounted sign apparatus is accomplished in a facilitated manner by firstly installing the post means in the ground in a substantially upright position. Retaining pin means are then affixed to the sign panel means by snapping the two pieces together through the retaining pin holes which have been prepositioned in the sign panel means. The sign panel means is then telescopically interposed into the post means through the first end of the post means. Affixing the cap means to the first end of the post means thereby completes the retention of the sign panel means.

Storage of the sign apparatus is made easy as there are few pieces to keep track of and they can be stored flat in relatively little space.

BRIEF DESCRIPTION OF THE DRAWINGS

FIG. 1 of the drawings is an elevational view of the improved post-mounted sign apparatus shown in an assembled configuration.

FIG. 2 of the drawings is a partial cross-sectional view of the post member having the sign panel member retained therein;

FIG. 3 of the drawings is a cross-sectional view of the post member showing the cooperation of the retaining pin means and longitudinal slot to substantially retain the sign panel member; and FIG. 4 of the drawings is a front exploded perspective view of the sign apparatus showing the affixation of the retaining pin means upon the sign panel member and detailing the assembly of the sign apparatus.

DETAILED DESCRIPTION OF THE DRAWINGS

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Improved modular post-mounted sign apparatus 10 is shown in FIG. 1 maintaining a sign panel means 11 in a substantially retained fashion. Sign panel means 11 is shown as a rectangular four-sided panel having indicia 12 imprinted thereon. Sign panel means 11 is further shown interposed into the interior internal cavity portion of post means 14.

Retaining pin means 25 is shown operably affixed to the face of sign panel means 11 in the region 18 of the sign panel means telescopically positioned within the internal cavity portion of post means 14. Cap means 13 is shown affixed to the first end of post means 14 thereby serving to seal the open end of post means 14.

Foot bar 15 is operably affixed toward the second end of post means 14 substantially perpendicular thereto. Additionally, the second end of post means 14 is shown including a stake means 16 formed by diagonally cutting the second end of post means 14 to thereby create a pointed end.

FIG. 2 of the drawings shows the cooperation of retaining pin means 25, which are affixed to sign panel 11, and the longitudinal slot 20 serving to maintain sign panel means 11 in a substantially retained position within post means 14. The sign panel means 14 illustrated comprises a substantially square hollow channel-like post having an open first end. Post means 14 is shown having four walls 21, 22, 23 and 24 wherein wall 21 is substantially parallel to wall 23 and wall 22 is substantially parallel to wall 24. Longitudinal slot 20 is shown extending from the first end of post means 14 toward the second end of post means 14, a distance corresponding to the length of side 17 of sign panel 11 interposed therewith and the height of cap means side 13*a*. Specifically, longitudinal slot 20 extends from the open end of post means 14 and terminates at lower edge 40.

Sign panel means 11 is shown having retaining pin means 25 operably affixed to opposing faces of sign panel means 11. In the embodiment illustrated, retaining pin means 25 is composed of first flange means 27, second flange means 26 and axis means 28. In addition, sign panel means 11 includes retaining pin holes 29 through which are positioned axis means 28 of retaining pin means 25. As can be seen from the cutaway portion of FIG. 2, the affixation of retaining pin means 25 to the sign panel means 11 serves to effectively increase the width of region 18 of sign panel means 11 which is telescopically interposed into the interior cavity of post means 14. Accordingly, sign panel means 11 is unable to be removed from post means 14 through longitudinal slot 20 since retaining pin means 25 obstructs its removal therefrom. Also shown in FIG. 2 is cap means 13 comprising a snap fit cap where cap portion 13*a* nests into the internal cavity and is held by friction against walls 21, 22, 23 and 24 of post means 14. As further shown in FIG. 2, the lower edge of sign panel means 11 rests upon edge 40 of longitudinal slot 20.

FIG. 3 specifically illustrates two embodiments of the cooperation of retaining pin means 25 and slot 20. Retaining pin means 25 are shown comprised a first flange means 27, a second flange means 26 and an axis means 28 wherein axis means 28 is operably positioned through retaining pin hole 29 so as to become affixed to sign panel means 11. Axis means 28 is shown having a length which maintains the first flange means 27 and second flange means 26 in substantial abuttment with adjacent internal cavity surfaces 35 and 34 respectively. Longitudinal slot 20 is shown having a width substantially corresponding to the thickness of sign panel means 11. Upon assembly of the apparatus 10, it can be seen that retaining pin means 25 prevents the removal of sign panel means 11 through longitudinal slot 20 as retaining pin means 25 serves to increase the effective width of the interposed portion of sign panel means 11 to a width greater than that of longitudinal slot 20. In the embodiment illustrated in solid line, retaining pin hole 29, which determines the placement and location of retaining pin means 25 is positioned such that first flange means 27 and second flange means 26 are each substantially abutting internal cavity surface 32 proximate to longitudinal slot 20 and such that side 17 of sign panel means 11 is substantially abutting interior cavity surface 31 opposite slot 20. Accordingly, it can be seen that this placement of retaining pin means 25 results in a substantially tight fit and interior position of sign panel means 11 with post means 14. In the embodiment illustrated in dashed lines, retaining pin hole 29, which determines the placement and location of retaining pin means 25 is positioned and first flange means 27 and second flange means 26 are of a width substantially corresponding to the distance between interior cavity surfaces 32 and 31 such that first flange means 27 and second flange means 26 are each substantially abutting both internal cavity surface 32 proximate to longitudinal slot 20 and interior cavity surface 31 opposite slot 20.

FIG. 4 illustrates the assembly of the improved modular post-mounted sign apparatus 10. First flange means 27 having axis means 28 affixed thereto is shown connected to second flange means 26 through retaining pin hole 29. Sign panel means 11 having retaining pin means 25 affixed thereto is shown telescopically interposed into internal cavity 30 of post means 14 via the open first end of post means 14. Upon complete interposition therein, it can be seen that the lower portion 33 of sign panel means 11 rests upon lower edge 40 of slot 20. Cap 13 is then shown being placed and affixed to the first end of post means 14 to thereby seal that first end and substantially complete the retainment of sign panel means 11 in and by post means 14.

Referring to FIG. 1, it can be seen now that the cooperation of retaining pin means 25 with longitudinal slot 20 results in the sign apparatus 10 being resistant to forces perpendicular to post means 14 and parallel with sign panel means 11, such as would be experienced if sign panel means 11 were to be pulled outwardly from post means 14. Further, the cooperation of retaining pin means 25 and lower edge 40 of slot 20 and cap means 13 causes the sign apparatus 10 to be substantially resistant to forces other than those parallel with the sign panel means 11. Still further, the particular placement and affixation of retaining pin means 25 to sign panel means 11 with the abutment of sign panel means edge 17 and channel wall 24 result in said apparatus 10 being substantially resistant to forces substantially perpendicular to the face of sign panel means 11.

The foregoing description and drawings merely explain and illustrate the invention and the invention is not limited thereto, except insofar as the amended claims are so limited as those skilled in the art who have the disclosure before them will be able to make modifications and variations therein without departing from the scope of the invention.

What is claimed is:

1. An improved modular post-mounted sign apparatus for maintaining a sign in a substantially retained fashion while providing for the facilitated assembly, disassembly and storage of said sign apparatus, said improved modular post-mounted sign apparatus comprising:

sign panel means having at least one side portion substantially retained by said post, said sign panel means serving to carry indicia to be displayed thereon;

elongated post means having a first end and a second end, said post means including an internal cavity extending from said first end of said post means toward said second end of said post means a distance corresponding to at least the length of said side portion of said sign panel means to be retained therewithin, said internal cavity thereby defining a plurality of internal cavity surfaces within said post means, said post means further having a portion including a slot extending longitudinally from said first end of said post means toward said second end of said post means a distance corresponding to at least the length of said side portion of said retained sign panel means, said slot further having a width substantially corresponding to the thickness of said sign panel means, whereby said post means is capable of telescopically accepting the interpositioning of at least said side portion of said sign panel means into said internal cavity portion of said post means so as to leave the remaining portion of said side panel means protruding outwardly from the said post means through said slot for display of said carried indicia;

retaining pin means operably affixed to said sign panel means side portion telescopically positioned within said internal cavity portion of said post means, said retaining pin means including a first flange means, a second flange means and a transverse member, said transverse member serving to connect said first flange means and second flange means in a substantially "H" shaped fashion, said transverse member being of such length so as to maintain said first flange means and said second flange means apart from one another in a position where each is thus substantially abutting a respective one of a pair of oppositely disposed internal cavity surfaces adjacent to the portion of said post means which includes said longitudinal slot, said retaining pin means thereby serving to prevent the passage of said portion of said sign panel means through said longitudinal slot, wherein said sign panel means having said retaining pin means affixed thereto may be alternatively inserted and removed from said internal cavity of said post means only through said first end of said post means, said retaining pin means being further operably disposed about said side portion of said sign panel means and cooperating therewith so as to constrain said sign panel means from lateral and angular motion relative to said post means;

closure means operably and removably affixed to said first end of said post means to thereby alternatively open and close said first end of said post means to substantially complete the retention and firm support of said sign panel means within said internal cavity of said post means when said closure means is in said alternatively affixed, closed position and permit the removal of said sign panel means through said first end of said post means when said closure means is in said alternatively unaffixed, open position.

2. The invention according to claim 1 in which said sign panel means includes a plurality of retaining pin holes extending from one face of said sign panel means through to the opposite face of said sign panel means about said sign panel means side portion telescopically positioned within said internal cavity portion of said post means to thereby accept and facilitate the positioning and secure affixation of said retaining pin means to said sign panel means.

3. The invention according to claim 2 in which said transverse member has a first end and a second end wherein said first end of said transverse member is operably affixed to said first flange means and wherein said second end of said transverse member is capable of removable affixation to said second flange means, such that said second end of said transverse member may be inserted into said retaining pin holes after which said second flange means may be affixed to said second end of said transverse member whereby said sign panel means may be positioned between said first and second flange means thereby serving to increase the effective thickness of said sign panel means side portion telescopically positioned within said internal cavity portion of said post means.

4. The invention according to claim 3 in which said post means comprises an elongated hollow channel-like post having four walls wherein opposite walls are substantially parallel with respect to one another and wherein one of said walls includes said longitudinal slot extending from said first end of said post means towards the second end of the post means corresponding to at least the length of said side of said sign panel means to be retained therein, said longitudinal slot having a width substantially corresponding to the thickness of said sign panel means.

5. The invention according to claim 1 in which said closure means comprises a snap fit plastic cap removably affixed to said first end of said post means to thereby seal said first end of said post means to further retain said sign panel means and further insulate said region of said sign panel means and retaining pin means positioned within said internal cavity from adverse weather conditions.

6. The invention according to claim 1 in which said improved modular post-mounted sign apparatus includes a foot bar operably affixed proximate to said second end of said post means substantially perpendicular thereto for facilitating the insertion of said sign apparatus in the ground to thereby permit said sign apparatus to be anchored in a substantially upright position.

7. The invention according to claim 1 in which said improved post-mounted sign apparatus includes a stake means operably affixed to said second of said post means for cutting the ground to facilitate the upright positioning of said sign apparatus.

8. The invention according to claim 7 in which said stake means is formed by diagonally cutting said second end of said post member to thereby create a pointed end.

9. The invention according to claim 1 in which said transverse member is operably positioned within said sign panel means so as to maintain said first flange means and said second flange means substantially abutting said internal cavity surface of said portion of said post means which includes said longitudinal slot while further maintaining said retained side portion of said sign panel means substantially abutting an internal cavity surface disposed opposite said longitudinal slot.

10. The invention according to claim 1 in which said first flange means and said second flange means are each of a width substantially corresponding to the distance extending normally between said internal cavity surface of said portion of said post means which includes said longitudinal slot and an internal cavity surface disposed opposite said longitudinal slot, whereby a portion of each of said first and second flange means substantially abut both the internal cavity surfaces of said portion of said post means which includes said longitudinal slot and said internal cavity surface disposed opposite said longitudinal slot, such that said retained side portion of said sign panel means does not contact said internal cavity surface.

11. The invention according to claim 1 in which said retaining pin means are composed of substantially weather resistant plastic material.

12. The invention according to claim 1 in which said post member is composed of square hollow steel channel-like material.

13. The invention according to claim 1 in which said sign panel member is composed of substantially rigid weather resistant material.

* * * * *

UNITED STATES PATENT AND TRADEMARK OFFICE

CERTIFICATE OF CORRECTION

PATENT NO. : 4,742,633

DATED : May 10, 1988

INVENTOR(S) : Snediker

It is certified that error appears in the above-identified patent and that said Letters Patent is hereby corrected as shown below:

Col. 1, line 47 "combersome" should be instead -- cumbersome --

Signed and Sealed this

Twenty-seventh Day of September, 1988

*Attest:*

DONALD J. QUIGG

*Attesting Officer* *Commissioner of Patents and Trademarks*